US005292274A

United States Patent [19]

Mutso et al.

[11] Patent Number: 5,292,274

[45] Date of Patent: Mar. 8, 1994

[54] METHOD OF MANUFACTURING A COLOR CRT TO OPTIMIZE THE MAGNETIC PERFORMANCE

[75] Inventors: Rein R. Mutso; Ralph J. D'Amato, both of Lancaster, Pa.

[73] Assignee: Thomson Consumer Electronics, Inc., Indianapolis, Ind.

[21] Appl. No.: 37,046

[22] Filed: Mar. 25, 1993

[51] Int. Cl.[5] ..... C23C 8/10

[52] U.S. Cl. ..... 445/47; 148/287; 445/58

[58] Field of Search ..... 445/47, 58; 148/286, 148/287

[56] References Cited

U.S. PATENT DOCUMENTS

| | | | |
|---|---|---|---|
| 2,269,943 | 1/1942 | Kiser | 148/16 |
| 3,510,366 | 5/1970 | Mears | 148/6.35 |
| 4,035,200 | 7/1977 | Valentijn | 148/6.35 |
| 4,325,752 | 4/1982 | Suda et al. | 148/12.1 |
| 4,448,612 | 5/1984 | Ebert et al. | 148/6.35 |
| 4,612,061 | 9/1986 | Suzuki et al. | 148/6.35 |
| 4,714,497 | 12/1987 | Poncet | 148/6.35 |
| 4,769,089 | 9/1988 | Gray | 445/47 X |
| 4,810,927 | 3/1989 | Watanabe | 445/47 X |
| 4,872,924 | 10/1989 | Kumada et al. | 445/47 X |
| 4,872,924 | 10/1989 | Kumada et al. | 148/12.1 |
| 5,094,920 | 3/1992 | Shiozaki et al. | 428/472.1 |

*Primary Examiner*—Kenneth J. Ramsey

*Attorney, Agent, or Firm*—Joseph S. Tripoli; Dennis H. Irlbeck; Vincent J. Coughlin, Jr.

[57] ABSTRACT

The magnetic performance of a color CRT is optimized by firing ferromagnetic components thereof in an exothermic atmosphere to anneal the components and form a stable black iron oxide layer on a surface thereof. The components are introduced into a furnace having such an atmosphere and the components are heated to a temperature sufficient to initiate pre-oxidation of the surface thereof. The temperature is then increased to optimize the magnetic characteristics of the components and at least partially relieve stress therein. The components are next cooled to a temperature at which the thickness of the stable black oxide layer on the surface of the components is optimized. A CRT is manufactured according to the process described above.

5 Claims, 3 Drawing Sheets

METHOD OF MANUFACTURING A COLOR CRT TO OPTIMIZE THE MAGNETIC PERFORMANCE

The invention relates to a method of manufacturing a color cathode-ray tube (CRT) to optimize its magnetic performance by firing the internal ferromagnetic components thereof in a suitable atmosphere and according to a heating schedule which forms a stable black iron oxide on a surface of said components while annealing said components and optimizing the magnetic characteristics thereof.

BACKGROUND OF THE INVENTION

A color CRT includes a faceplate and a funnel which are integrally joined together, e.g., by frit sealing. The inside surface of the faceplate is covered with a phosphor screen composed of triads of phosphor elements which emit the three primary colors of light, red, green and blue when impacted by electrons. An electron gun is mounted in a neck portion of the funnel in a position remote from the faceplate. The electron gun provides three electron beams which scan the phosphor triads and cause the desired image to be produced. A shadow mask having a multiplicity of openings, or apertures, therethrough is located in proximity to the screen and is used as a color selection electrode to assure that each of the three electron beams impacts the phosphor of the proper light emitting color. Thus, for example, the electron beam which is modulated with red data impacts the phosphor elements which emit red light. Because the electrons of the beams are charged particles, the earth's magnetic field has an influence on their trajectories which can cause the electrons to impact a phosphor of the improper color, a phenomena known as misregistry. For this reason, a magnetic shield is commonly used, either in the interior or on the exterior, of the CRT, to shield a substantial portion of the electron beams trajectories from the influence of the earth's magnetic field. It is current practice to utilize an internal magnetic shield (IMS) which is attached to a shadow mask frame and extends toward the electron gun.

The magnetic effect on electron beams, which causes misregistry, occurs in the directions which are perpendicular and parallel to the longitudinal axis of the CRT. For this reason, various changes in the configuration, structure, or processing of the internal magnetic shield, the shadow mask, and the frame can beneficially influence the misregistration in one direction and adversely influence it in an orthogonal direction. Misregistry must be corrected, or minimized, in all three orthogonal field directions: axial, horizontal, and vertical. The axial (north-south) field acts parallel to the longitudinal axis of the CRT. The horizontal (east-west) field and vertical fields act along the horizontal (major) and vertical (minor) axes of the faceplate, respectively.

It is known in the art to improve the magnetic shielding characteristics of the internal components of the color CRT by annealing the components, usually within the range of 700°-850° C., in a non-oxidizing atmosphere, and then blacken the components, in a separate step, in an oxidizing atmosphere at a temperature of 550°-600° C. Alternatively, some CRT manufacturers are omitting the magnetic annealing treatment to reduce costs. However, this provides a tradeoff of cost versus performance that may be unacceptable.

An acceptable alternative, in which CRT performance is not sacrificed to reduce cost, can be achieved by the novel one-step magnetic anneal and blackening process described herein.

SUMMARY OF THE INVENTION

The magnetic performance of a color CRT is optimized by firing ferromagnetic components thereof in an exothermic atmosphere to anneal the components and form a stable black iron oxide layer on a surface thereof. The components are introduced into a furnace having such an atmosphere and the components are heated to a temperature sufficient to initiate pre-oxidation of the surface thereof. The temperature is then increased to optimize the magnetic characteristics of the components and at least partially relieve stress therein. The components are next cooled to a temperature at which the thickness of the stable black oxide layer on the surface of the components is optimized. A CRT is manufactured according to the process described above.

DETAILED DESCRIPTION OF THE PREFERRED EMBODIMENT

Figure 1:
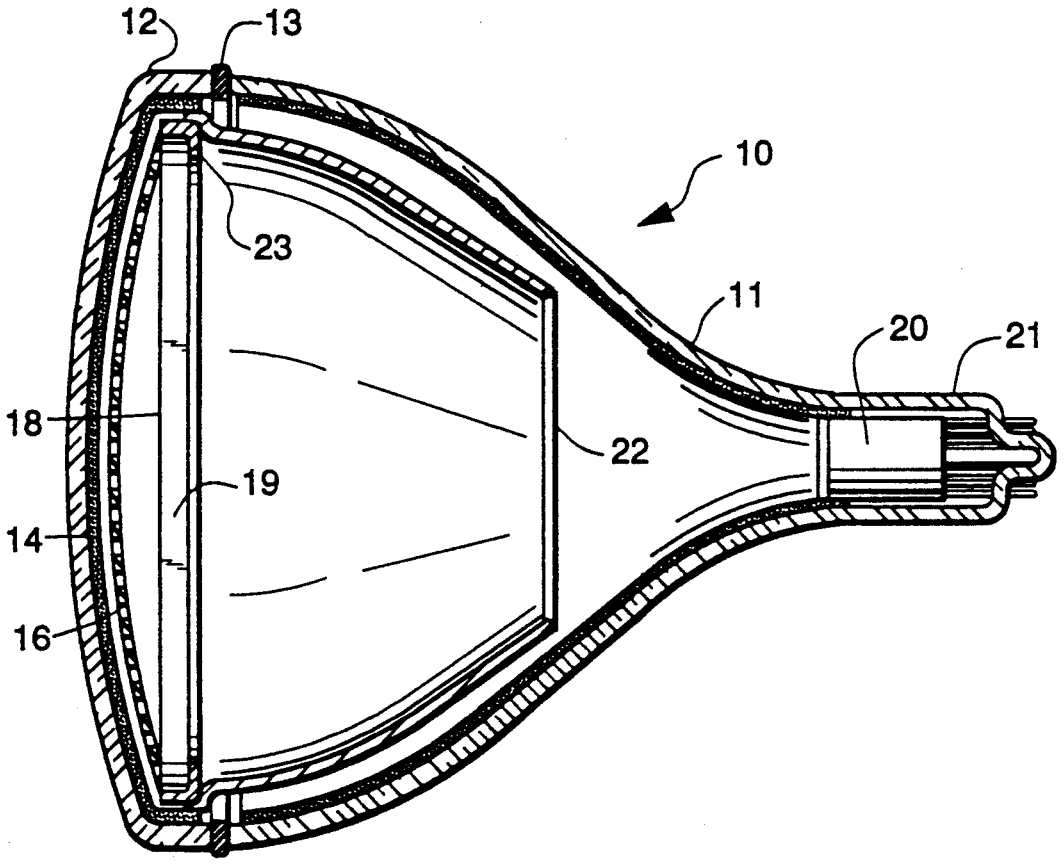
FIG. 1 is a cross sectional view of a color CRT made according to the novel process.

FIG. 1 shows a color CRT 10 which includes a funnel 11 and a substantially rectangular faceplate 12 which are integrally joined at a frit seal line 13. A phosphor screen 14 is arranged on the inside surface of the faceplate 12. The phosphor screen 14 is composed of triads of phosphor elements. Each element emits one of the three primary colors of light when impacted by one of the three electron beams. Preferably, the phosphor screen is a line screen with the phosphor lines extending substantially perpendicular to the high frequency raster line scan of the CRT (normal to the plane of FIG. 1). Alternatively, the screen can be a dot screen. A multiapertured color selection electrode, or shadow mask, 16 is secured to one surface 18 of a frame 19. The shadow mask is spaced a predetermined distance from the phosphor screen 14 and is used to direct the three electron beams to the phosphor elements which emit the appropriate colors of light. The apertures in the shadow mask correspond to the shape of the phosphor screen elements. If the screen is a line screen, the mask apertures are rectangular slots, and if the screen is a dot screen, the mask apertures are circular openings. An electron gun 20 is arranged in a neck portion 21 of the funnel 11 to generate three electron beams toward the screen to scan the phosphor elements thereof.

The electrons within the beams are charged particles, and accordingly, the electron beams are subject to deflection because of the influence of the earth's magnetic field. The effects of the earth's magnetic field are minimized by an internal magnetic shield (IMS) 22 attached to another surface 23 of the frame 19. The shadow mask 16, the frame 19 and the IMS 22 are composed of a ferromagnetic material, such as cold rolled AK steel, low carbon steel, or an iron-nickel alloy which has a lower coefficient of thermal expansion than the other materials mentioned. The aforementioned ferromagnetic components bend or redirect the magnetic field lines of the earth around the electron beams to minimize the effects on the beams as they pass within the shield and through the shadow mask. This is an important feature because the bending of the electron beam, caused by the earth's magnetic field, can cause a particular electron beam to impact on a phosphor element of the wrong light emitting color, thus resulting in misregistry, thereby degrading the quality of the image display. For example, bending of a beam trajectory to the right or left will result in a misregistry in a CRT with vertically oriented phosphor stripes, i.e., the beam will land to the right or left of the intended landing area (color stripe) on the screen. For dot screens, bending of the beam trajectory up or down, right or left, will cause the beam to land above or below, or to the right or left of the intended landing area (color dot). Additionally, when a television receiver containing a color CRT is moved from one position to another, either within a room, or to a different geographic location, the relative position of the axis of the CRT with respect to the earth's magnetic field, and even the strength and/or direction of the magnetic field, changes, possibly causing substantial degradation of the image display, because of additional misregistration of the electron beams. It should be noted that each component of the earth's magnetic field contributes to misregistry, and in order to optimize the performance of a color CRT, all three components of the magnetic field must be considered. Because the effect of the earth's magnetic field depends on the location and orientation of the CRT, optimum shielding requires the ability to remagnetize the ferromagnetic components to realign the magnetic domains after the CRT has been moved. In actuality, a degaussing coil, not shown, overlies a portion of the funnel, in the vicinity of the ferromagnetic components to remagnetize the components each time the receiver is turned on.

Figure 2:
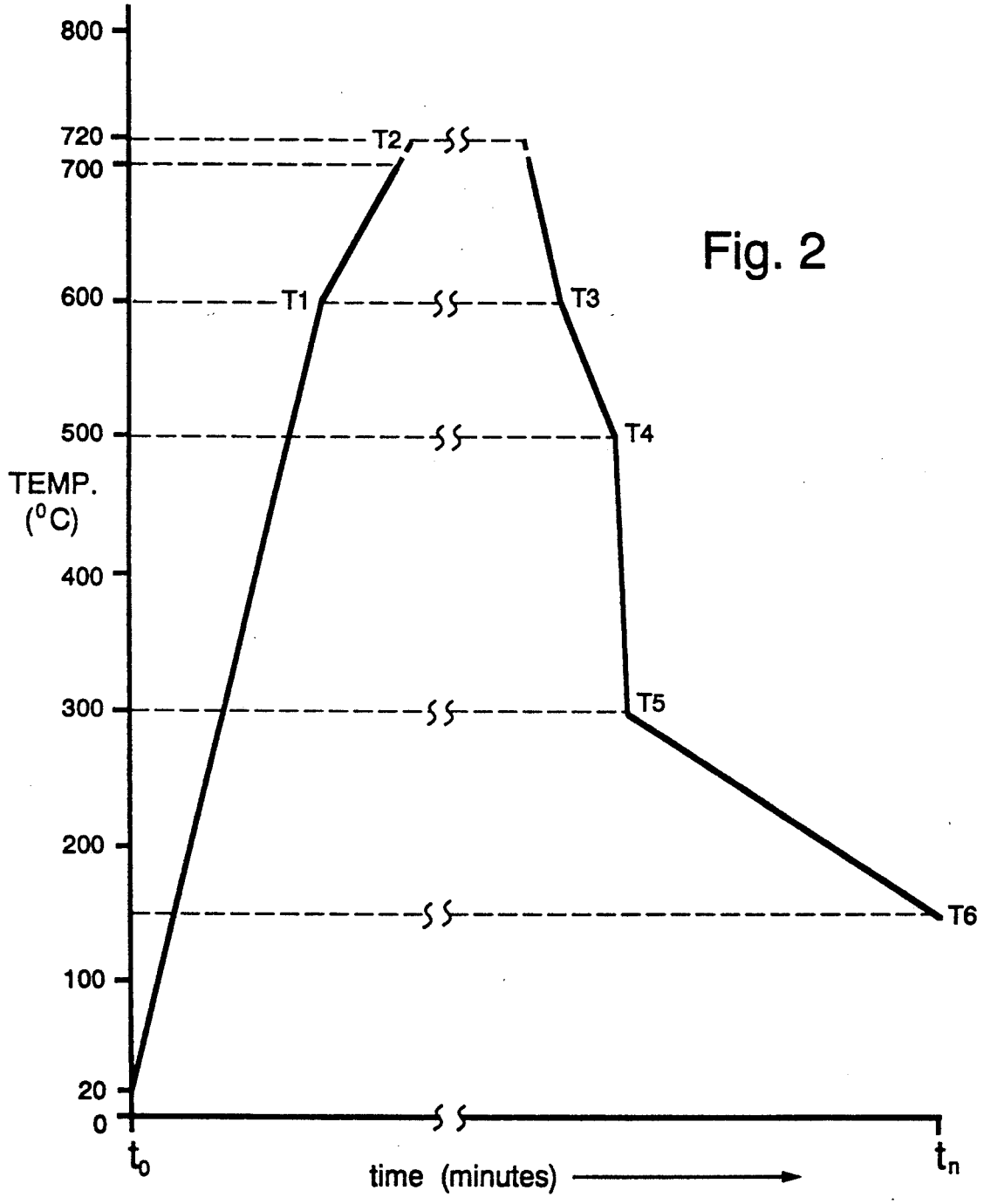
FIG. 2 is a graph of a temperature profile versus time to effect the novel one-step magnetic annealing and blackening of the present invention.

The temperatures for the novel one-step magnetic anneal and blackening process are shown in FIG. 2. The ferromagnetic components, comprising the shadow mask 16, the frame 19 and the IMS 22, are introduced, after the parts have been formed, but before being attached together, into a conventional blackening apparatus or furnace, not shown, by a belt feeder. The atmosphere of the furnace comprises "exalene", a lean exothermic atmosphere produced by partial combustion of a hydrocarbon, usually natural gas, and air. The exothermic atmosphere is a conventional, slightly oxidizing, heat treatment atmosphere, containing, by volume, about 2-3%$H_2$, 2-3%CO, 9-10% $CO_2$, a small quantity of $H_2O$, depending on the dew point (e.g., about 7°-10° C.) set by an external chiller at the exit end of the furnace, and the balance (~85%) $N_2$.

In a first zone of the furnace, the temperature (T1) is maintained at about 600° C. and the speed of the belt carrying the ferromagnetic components into the furnace is adjusted to about 100 cm per minute, to provide a heating rate of about 40° to 83° C. per minute and to initiate pre-oxidation of the surface of the components. The oxygen content of the atmosphere is high enough that surface oxidation with $Fe_3O_4$ begins immediately upon entry of the ferromagnetic components into the first zone. Very little FeO, which is an undesirable oxide, prone to flaking if it becomes too thick, is formed below 600° C.

In a second zone of the furnace, the temperature (T2) is maintained within the range of about 700°-720° C. The rate of temperature increase in zone 2 is about 20°-70° C. per minute. The components are maintained at a temperature above 700° C. for a minimum of about 3 minutes, to stress relieve the ferromagnetic components and optimize their magnetic properties. Optimize, in this context, means to increase the magnetic permeability and lower the coercivity of the ferromagnetic components so that misregistry resulting from each of the three components of the earth's magnetic field is minimized at the critical corners of the CRT, thereby optimizing the performance of the tube.

The ferromagnetic components next pass into a first cooling zone of the furnace, where the temperature is decreased from the peak temperature (T2) to a temperature (T3) of about 600° C., at a rate of about 70°-93° C. per minute. The total heating time above 600° C. is a minimum of about 8 minutes.

As the ferromagnetic components pass into a second cooling zone, air is introduced into the gaseous atmosphere of that portion of the furnace, to further cool the components to a temperature (T4) of about 500° C., at a rate of about 40°-83° C. per minute. A stable black iron oxide (predominantly $Fe_3O_4$ with traces of FeO and $Fe_2O_3$) having good adherence is built up in this section of the furnace. By controlling the air input, the oxide thickness may be optimized to provide a thickness of 1-1.5 microns.

The ferromagnetic components are rapidly cooled in a third zone from 500° C. to a temperature (T5) of about 300° C., at a rate of about 130°-173° C. per minute, to inhibit further oxidation of the surface of the components.

Finally, the components are slowly cooled in a fourth zone to a temperature (T6) of about 150° C., at a rate of about 10°-12.5° C. per minute, after which they are removed from the furnace and allowed to reach room temperature.

Figure 3:
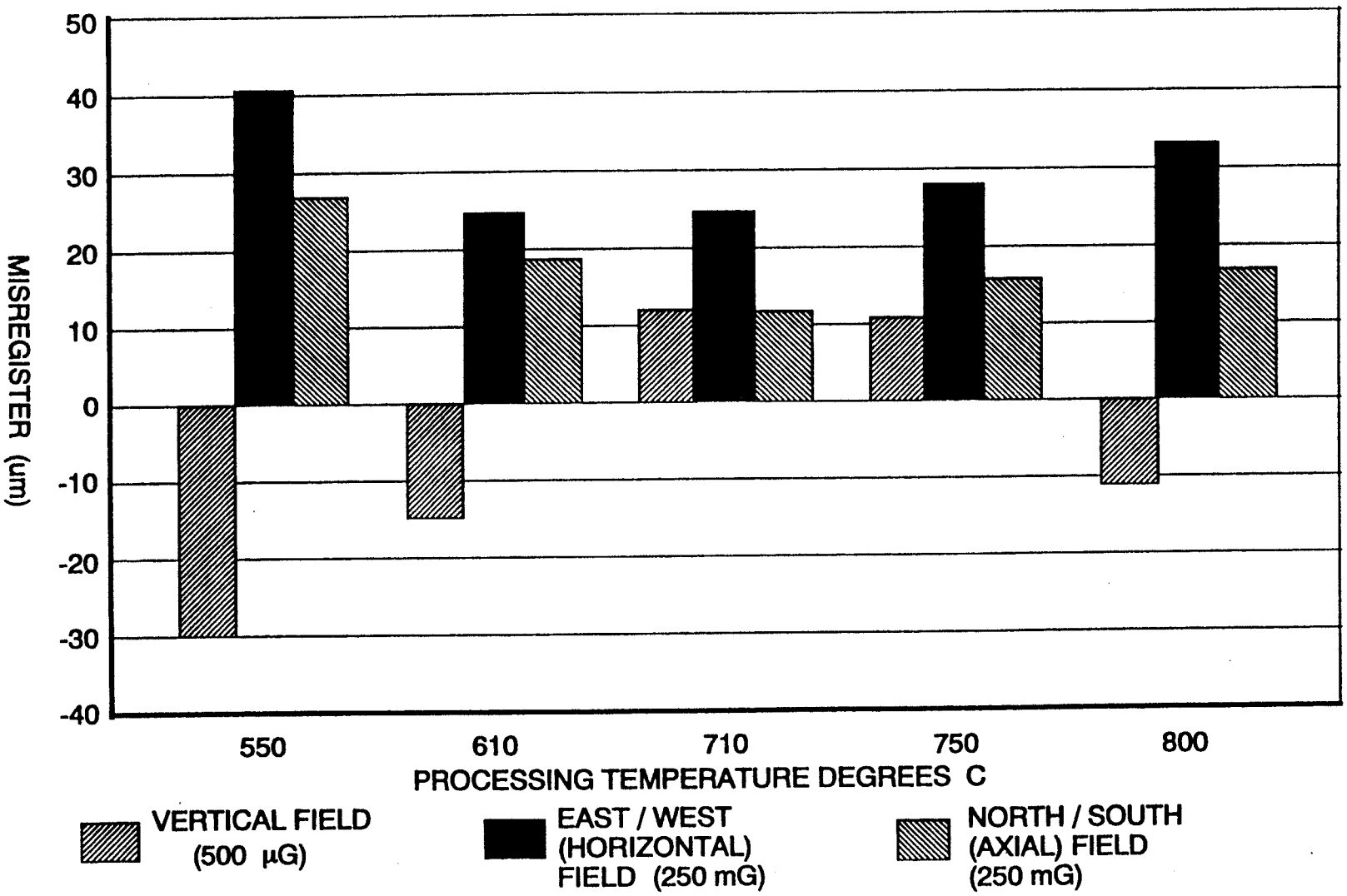
FIG. 3 is a graphic representation of the average electron beam corner misregister for all three components of a magnetic field as a function of the processing temperature of the ferromagnetic components of the CRT.

CRT's made using ferromagnetic components processed according to the novel one-step magnetic annealing and blackening process described above, demonstrate better magnetic performance than tubes containing ferromagnetic components processed at lower or higher temperatures in an identical furnace atmosphere. As shown in FIG. 3, the average corner misregister of an electron beam (here the green phosphor impacting beam) in a 79 cm diagonal CRT having a 110 degree deflection angle with ferromagnetic components processed at a maximum temperature of 710° C., and subjected to a 500 milligauss (mG) vertical magnetic field, with East - West, and North - South components of about 250 mG, which approximates the average magnetic field for the United States, is less for each of the three magnetic field components [vertical, East - West (along the major axis of the CRT) and North - South (along the z-axis of the CRT] than for similar ferromagnetic components processed at peak temperatures of 550°, 610°, 750°, and 800° C., with all other furnace parameters being identical. This result is surprising with respect to higher annealing temperatures because it is generally believed that greater restoration of the magnetic properties, after forming, are achieved by annealing at temperatures approaching 800° C. Note that in FIG. 3, negative misregister represents a bending of the electron beam in a direction opposite to that for positive misregister. At the optimum peak processing temperature (T2) of 710° C., the misregister due to the vertical field, which is directed along the minor axis of the faceplate, is about 12 micrometers, the same amount of misregister also is due to the North - South field which is directed along the z- or electron beam- axis of the CRT. The East - West misregister at this optimum temperature is about 25 micrometers. The results shown in FIG. 3 are obtained by first degaussing the CRT which is operating in an environment in which it is shielded from the magnetic field of the earth. A calibrated vertical field of 500 milligauss is established in the test facility. This field represents the average vertical field for the United States. With the electron gun operating to produce only one beam, in this instance the green phosphor impacting beam, measurements are made in the corners of the CRT, on each of the three magnetic field components generated by the calibrated fields, and averaged to provide the values shown in FIG. 3. The corner measurements typically represent the worst-case situation because of the extreme deflection the beam, the longer beam paths to the corners, and the absence of any misregister on the major axis due to horizontal or axial fields.

What is claimed is:

1. A method of manufacturing a CRT to optimize its magnetic performance by firing ferromagnetic components thereof to anneal said components and form a stable black oxide layer on a surface thereof, including the steps of 'introducing said components into a furnace having an exothermic atmosphere, said components being heated to an initial temperature sufficient to initiate a pre-oxidation on said surface thereof, increasing said temperature to a subsequent temperature to optimize the magnetic characteristics of said components and at least partially relieve stress therein, and cooling said components to a predetermined temperature, lower than said initial and said subsequent temperatures, while air is introduced into a zone of said furnace to optimize the thickness of said stable black iron oxide layer formed on said surface of said components.

2. A method of manufacturing a CRT to optimize its magnetic performance by firing a plurality of ferromagnetic components thereof to anneal and form a stable black iron oxide layer thereon, said CRT comprising an envelope having a substantially rectangular faceplate and a funnel with a line screen formed on an interior surface of said faceplate; said components including a shadow mask, a frame, and an internal magnetic shield, said shadow mask being spaced from said screen and secured to a surface of said frame within said envelope, said internal magnetic shield being secured to another surface of said frame; and an electron gun disposed within said envelope to generate at least one electron beam toward said screen, said method including the steps of introducing said components into a furnace having an exothermic atmosphere, said components being heated to a first temperature (T1), at a first rate of increase, sufficient to initiate a pre-oxidation on said surface thereof, increasing said temperature, at a second rate of increase, to a second temperature (T2), to optimize the magnetic properties of said components, whereby the misregister of said electron beam on said line screen is reduced, cooling said components in a first zone to a third temperature (T3), at a first rate of temperature decrease, further cooling said components in a second zone to a fourth temperature (T4), at a second rate of temperature decrease, while introducing air into said second zone, to optimize the thickness of said oxide on said surface of said components, rapidly cooling said components in a third zone to a fifth temperature (T5), at a third rate of temperature decrease, greater than said first and said second rates of decrease, to inhibit further oxidation of said surface of said components, and slowly cooling said components in a fourth zone after the formation of said oxide to a sixth temperature (T6), at a fourth rate of temperature decrease which is less than said first, said second, and said third rates of temperature decrease.

3. The method as described in claim 2, wherein said first and third temperatures (T1) and (T3), respectively, are approximately equal.

4. A method of manufacturing a CRT to optimize the magnetic performance thereof by firing a plurality of ferromagnetic components to anneal and form a stable black iron oxide layer thereon, said CRT comprising an envelope having a substantially rectangular faceplate and a funnel, a line screen formed on an interior surface of said faceplate; said components including a shadow mask, a frame, and an internal magnetic shield, said shadow mask being spaced from said screen and secured to a surface of said frame within said envelope, said internal magnetic shield being secured to another surface of said frame; and an electron gun disposed within said envelope to generate three electron beams toward said screen, said method including the steps of introducing said components into a furnace having an exothermic atmosphere, said components being heated to a temperature of about 600° C. at a heating rate of about 40° to 83° C./min., increasing said temperature at a rate of about 20°-70° C./min., to a peak of about 720° C. and maintaining said components above 700° C. for a minimum of about 3 min., to optimize the magnetic properties of said components, whereby misregister of said electron beams on said line screen is reduced, cooling said components from said peak temperature to about 600° C. at a rate of about 70° to 93° C./min., said total heating time above 600° C. being a minimum of about 8 min., further cooling said components from about 600° C. to about 500° C. at a rate of about 40° to 83° C./min., while injecting air into said furnace, rapidly cooling said components from about 500° C. to about 300° C. at a rate of about 130° to about 173° C./min., and slowly cooling said components to about 150° C. at a rate of about 10° to 12.5° C./min.

5. The CRT manufactured in accordance with the method of claim 1.

* * * * *